US008172216B2

(12) United States Patent
Oosterhoff et al.

(10) Patent No.: US 8,172,216 B2
(45) Date of Patent: May 8, 2012

(54) APPARATUS AND METHOD FOR GATHERING DOCUMENTS

(75) Inventors: Hans Oosterhoff, Hoogeveen (NL); Melle Jonker, Drachten (NL); Fokke De Boer, Boornbergum (NL)

(73) Assignee: Neopost Technologies, Bagneux (FR)

( * ) Notice: Subject to any disclaimer, the term of this patent is extended or adjusted under 35 U.S.C. 154(b) by 209 days.

(21) Appl. No.: 12/645,157

(22) Filed: Dec. 22, 2009

(65) Prior Publication Data

US 2010/0156026 A1 Jun. 24, 2010

(30) Foreign Application Priority Data

Dec. 24, 2008 (EP) ..... 08172944

(51) Int. Cl.
*B65H 83/00* (2006.01)

(52) U.S. Cl. ..... 271/3.14; 271/3.17

(58) Field of Classification Search ..... 271/3.14, 271/3.17

See application file for complete search history.

(56) References Cited

U.S. PATENT DOCUMENTS

| | | | |
|---|---|---|---|
| 5,083,769 | A | 1/1992 | Young, Jr. |
| 5,090,671 | A | 2/1992 | Gombault et al. |
| 5,258,817 | A | 11/1993 | Acquaviva |
| 5,339,603 | A | 8/1994 | Gombault et al. |
| 5,362,037 | A | 11/1994 | van der Werff et al. |
| 5,375,825 | A | 12/1994 | Kennish |
| 5,954,207 | A | 9/1999 | Yamashita et al. |
| 6,054,666 | A | 4/2000 | Yamashita et al. |
| 2004/0251614 | A1 | 12/2004 | Peeters |

FOREIGN PATENT DOCUMENTS

| | | |
|---|---|---|
| EP | 0 556 922 | 8/1993 |
| EP | 1927565 A2 | 6/2008 |

OTHER PUBLICATIONS

European Search Report for EP 08 17 2944 dated Jun. 5, 2009.

*Primary Examiner* — Michael McCullough
(74) *Attorney, Agent, or Firm* — Sughrue Mion, PLLC

(57) ABSTRACT

An apparatus and method in which documents and enclosures are fed by feeding stations to a supply track and subsequently transported along the supply track to a gathering station. A sensor downstream of the feeding stations is used for scanning markings. A divert station connected to the supply track allows clearing the supply track, when scanned markings indicate that the first sheet of a next set has been scanned in the supply track, by diverting the first sheet to the divert station. This allows enclosures of the set being gathered to be fed along the supply track and gathered at the gathering station. After the completed set has vacated the gathering station, the diverted sheet is transported to the gathering station and gathered with further documents of the next set.

6 Claims, 1 Drawing Sheet

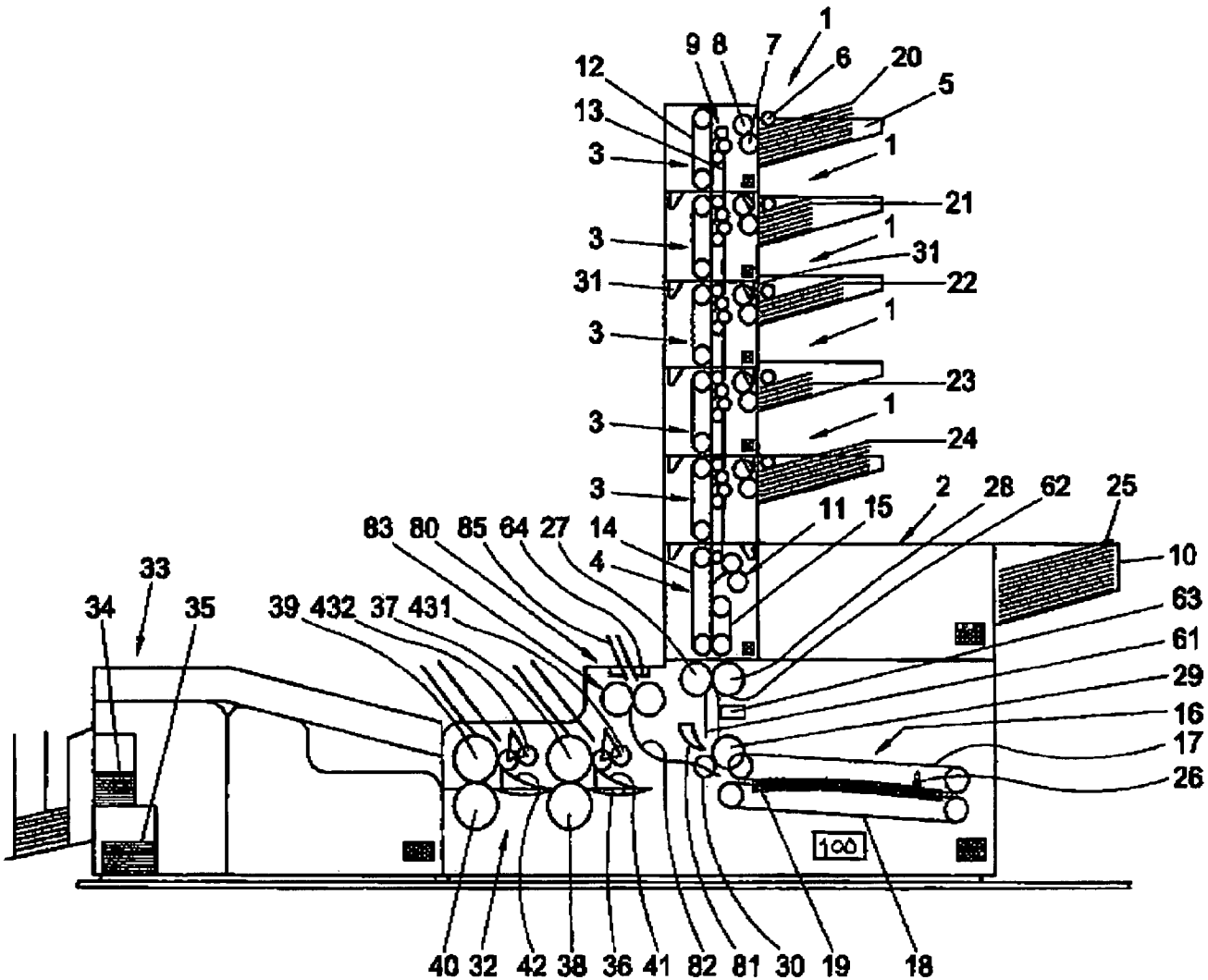
1
6
7
9 8
20
5
12
13
3
1
21
1
3
31
22
1
31
3
23
1
3
24
1
3
2
28
62
25
10
11 15
14
4
27
85 64
83 80
39 432
37 431
63
61
29
16
17
26
18
19
30
81
82
41
36
38
42
32
40
35
33
34
100

APPARATUS AND METHOD FOR GATHERING DOCUMENTS

CROSS-REFERENCE TO RELATED APPLICATION

This application claims priority to Oosterhoff, EP Application 08172944.4, filed on Dec. 24, 2008, entitled "Apparatus and Method For Gathering Documents," the contents of which are expressly incorporated by reference in their entirety, including any references contained therein.

FIELD AND BACKGROUND OF THE INVENTION

The invention relates to an apparatus and a method for gathering documents. An example of such an apparatus is disclosed in European patent 0 566 922. In this apparatus, the documents to be gathered, in practice generally main documents and enclosures to be added thereto, are placed in separate feeding stations and transported along a supply track towards a gathering station. Unlike enclosures, sheets or other postal items constituting main documents usually contain information intended for a specific addressee. In particular if enclosures are to be added to main documents selectively in accordance with marks read from the main document, the enclosures of each set are preferably fed after the personalized or address carrying sheets of the main document of the respective set. The enclosures are fed in response to the feeding of the last main document of a set. The feeding of the last main document of a set may, for example, be detected by a sensor for scanning markings on a sheet and generating a signal in accordance with the scanned markings, which signal providing an indication whether or not the last sheet of a main document of a set has been fed.

For obtaining a small, compact and low cost system, it is advantageous that the gathering of a set occurs downstream of the feeding stations and that the sensor along the supply track can scan markings from all documents (main documents and enclosures).

Sometimes markings indicating that a document is a last main document of a set are not provided. Instead only a marking is provided on each first main document of each set. This would present a problem because, when markings on a document are detected indicating that it is the first main document of a next set, the previous main document was the last main document of the set being gathered and the first document of the next set would be added to the wrong set or block the supply track for enclosures to be added to the completed set of main documents.

SUMMARY OF THE INVENTION

It is an object of the disclosed apparatus and method to gather documents in a station downstream of the feeding stations. The method and apparatus allows sets of main documents and enclosures to be gathered in accordance with markings indicating a first main document of each set only.

This object is achieved by an apparatus for gathering documents having a supply track, at least two feeding stations for feeding documents to the supply track, at least one gathering station for gathering documents arriving via the supply track into a stack, a sensor along the supply track downstream of at least one of the feeding stations and upstream of the gathering station for scanning markings from documents in the supply track and generating signals in accordance with the scanned markings, and a divert station for diverting a document from the supply track downstream of the sensor and upstream of the gathering station.

The apparatus is further provided with a drive structure for driving displacement of documents from the feeding stations along the supply track to the gathering station, for driving displacement of documents from the supply track to the divert station, for driving displacement of documents stacked in the gathering station, and for driving displacement of documents from the divert station along the supply track to the gathering station.

The apparatus has a control system arranged for controlling the drive structure for driving, in response to a signal from the sensor representing a predetermined mark read from a document fed from one of the feeding stations, displacement of the document from the supply track into the divert station, subsequently driving displacement of at least one document from another one of the feeding stations to the gathering station, subsequently driving displacement of the documents stacked in the gathering station thereby clearing the gathering station, and subsequently driving displacement of the document in the divert station to the gathering station.

According to the disclosed embodiments, the above object is also achieved by a method for gathering documents in an apparatus having a supply track, at least two feeding stations for feeding documents to the supply track, at least one gathering station for gathering documents arriving via the supply track into a stack, a sensor along the supply track downstream of at least one feeding station and upstream of the gathering station, for scanning markings from documents in the supply track and generating signals in accordance with the scanned markings, a divert station for diverting a document from the supply track downstream of the sensor and upstream of the gathering station, and a drive structure for driving displacement of documents from the feeding stations along the supply track to the gathering station, for driving displacement of documents from the supply track to the divert station, for driving displacement of documents stacked in the gathering station, and for driving displacement of documents from the divert station along the supply track to the gathering station, and a control system for controlling the drive structure.

In the above-summarized apparatus, the method includes: driving, in response to a signal from the sensor representing a predetermined mark read from a document fed from one of the feeding stations, displacement of the document from the supply track into the divert station, subsequently driving displacement of at least one document from another one of the feeding stations to the gathering station, subsequently driving displacement of the documents stacked in the gathering station thereby clearing the gathering station, and subsequently driving displacement of the document in the divert station to the gathering station.

When scanned markings indicate that the first main document of a next set has been detected in the supply track, by diverting this first main document to the divert station, the supply track may be cleared for allowing enclosures to be added to and gathered with the main document or documents in the gathering station. Then, the gathered set of documents can be transported away from the gathering station and after the gathering station has been vacated, the diverted first document of the next set can be transported from the divert station to the gathering station and the feeding and gathering of next documents of the next set can commence.

Particular elaborations and embodiments of the invention are set forth in the dependent claims.

Further features, effects and details of the invention appear from the detailed description and the drawings.

BRIEF DESCRIPTION OF THE DRAWING

The single drawing FIGURE shows a schematic cut-away side elevational view of an example of a postal assembling system according to an illustrative embodiment of the invention.

DETAILED DESCRIPTION

In the drawing, an apparatus is shown that is equipped with a plurality of feeding stations 1, 2 for delivering documents 20, 25, of which the bottom one is implemented as a printer 2. Each of the first four feeding stations includes: a container 5, a supply roller 6, a separating roller 7, a transport roller 8 and a pair of feeding rollers 9. An example of a separating device suitable for use in a feeder according to the exemplary embodiment shown is described in more detail in applicant's U.S. Pat. No. 5,362,037, to which reference is being made here for purposes of incorporating the disclosure contained therein.

The last feeding station, the printer, has a container 10 for the sheets to be printed and a pair of feeding rollers 11 for delivering a printed sheet at a suitable moment. By way of example, the printer 2 is of such design that the printing of a sheet is completed before the sheet reaches a waiting position between the feeding rollers 11.

The feeding stations 1, 2 are combined with conveyors 3, 4 to form feeding/transport units connectable to each other. The conveyors 3 connected with the feeder stations 1 comprise conveyor belts 12, 13 which are staggered relative to each other and are partly positioned opposite each other. Of these conveyor belts, the conveyor belt 13 located downstream of a transport unit located upstream extends to opposite a conveyor belt 12 or 14 located upstream of a next transport unit 3 or 4 located downstream. Consequently, a document can be passed on to a next transport unit 3 or 4. The last transport unit 4 comprises conveyor belts 14, 15 located opposite each other and ending directly opposite each other.

The system further comprises a gathering station 16 for gathering documents belonging to a given set to a stack having on one side substantially aligned document edges.

The gathering station 16 is designed as a head station having a supply track and a gathering surface 19 with a displaceable stop 26. The supply track is formed by transport rollers 27, 28, 29, 30 and guides 61, 62, and the gathering surface 19 is formed by a portion of a conveyor belt 18 passing over a support. Documents supplied by the transport unit 4 can be carried along this supply track to the gathering surface 19.

The documents can be transported in the direction of supply to opposite the stop 26 and then be discharged in the opposite direction. The aligned document edges then form the trailing edge of the stack, which is advantageous when folding the stack. That is, the place of each fold is determined relative to the trailing edge of the stack of documents.

The stop 26 is attached to the conveyor belt 18. The stop 26 is displaced by running the conveyor belt 18.

Arranged opposite the gathering surface 19 are pressing means 17 which are displaceable in the direction of the stop 26 approximately parallel to the gathering surface 19. The pressing means 17 can apply some pressure to the gathering surface 19 and have a greater coefficient of friction than does the gathering surface 19. By displacing the pressing means 17 in the direction of the stop 26 documents present between the gathering surface 19 and the pressing means 17 can be pressed against the stop 26 so that the document edges on the side of the stop 26 are aligned relative to each other.

The gathering surface 19 is convexly curved in the direction of movement of the stop 26. The pressing means 17 are designed, by way of example, as an endless belt 17 subjected to a given tension, one end of which belt extends along the gathering surface 19. As a result of the tension of the endless belt 17 of the pressing means this belt applies an evenly distributed pressure in the direction of the gathering surface 19 in an area contiguous to the stop 26.

The conveyor belt 17 has a greater coefficient of friction relative to the material of the documents than does the conveyor belt 18. By driving the conveyor belt 17 for applying a pressure to a document located between the belts 17 and 18 in the direction of the stop 26 this document will move over the belt 18 against the stop 26. A next document partly carried between the preceding document and the conveyor belt 17 will also move over the preceding document against the stop 26 when the belt 17 is driven in the direction of the stop 26. Successive documents can thus be aligned.

In the system according to the embodiment shown, the stop 26 is removed from the gathering surface 19 by running the belt 18 until the stop 26 passes one of the end rollers thereof.

A divert station 80 connects to the supply track in a position downstream of the feeding stations 1, 2 and upstream of the gathering station 16.

The system according to the invention further comprises a control system 100 for controlling the various stations of the system. The control system is connected to the conveyor belts 12, 13, 14, 15, 17, 19 and rollers 6, 7, 8, 11, 27, 28, 29, 30, 83 which constitute a drive structure for the assembly of feeding stations, gathering station and divert station.

The divert station 80 has a divert switch 81, a divert guide 82 bounding a divert track, a pair of transport rollers 83, a chute 85 and a sensor 64. According to the present example, the divert switch 81 is movable from a shown rest position into a deflected position clearing the supply track for allowing sheets to pass along the supply track through the nip between the rollers 29, 30. The switch is pivotably suspended near its upper end so that a sheet being transported along the supply track to the gathering station 16 can urge the divert switch 81 into its deflected position. The divert track branches off from a section of the supply track at a nip between a most downstream pair of transport rollers 29, 30 of the supply track, which rollers 29, 30 are located upstream of the gathering station 16 and closely above the entry of the gathering station 16. The sensor 64 is positioned near the chute 85 for detecting the presence of a document in the chute 85, and is connected with the control system.

The system further comprises a folding station 32 for folding sets of gathered documents arriving from the gathering station 16. The documents have been stacked in alignment against the stop 26. The folding station 32 has first and second pairs of folding rollers 37, 38 and 39, 40, with the discharge track 36 extending through nips between the pairs of folding rollers 37, 38 and 39, 40. Between closely upstream of each of the pairs of folding rollers 37, 38 and 39, 40, deflectors 41 and 42 are arranged for deflecting a leading end of a stack that faces away from the stop 26. Opposite one of the folding rollers, pressing rollers 431, 432 are located for pressing a deflected portion of a stack against a circumferential surface of the folding roller 37 and 39, respectively.

An inserting station 33 connects to the folding station 32. The inserting station 33 is equipped with two containers 34, 35 for envelopes. As a base for such an inserting station 33, for example, a "Neopost IN2" can be used. A method for selecting, depending on the documents to be packaged, an envelope container for delivering an envelope is described in U.S. Pat.

No. 5,339,603, to which reference is being made here for purposes of incorporating the teachings herein by reference.

The supply track of the system extends from the conveyors 3, 4, along the transport rollers 27, 28, 29, 30, and guides 61, 62 to the gathering surface 19, which constitutes a head station, and then along the discharge track 36 and terminating at the inserting station 33.

In operation, when assembling a postal item using a system according to the exemplary embodiment shown, documents are delivered by the feeding stations 1, 2 to the transport units 3, 4. The documents are gathered by the gathering station 16 to form a stack having on one side substantially aligned document edges. This stack is supplied to the folding station 32 in a direction transverse to the aligned edges.

For scanning markings, address code, or other indicia from a sheet transported along the supply track, a sensor 63 is provided downstream of the feeding stations 1, 2 and upstream of the gathering station 32. The sensor 63 is connected with the control system for controlling the various stations of the system in response to signals from the sensor 63 representing the scanned markings. These markings can indicate whether a sheet belongs to the current set to be gathered or if it is the first sheet of a new set to be gathered.

When a marking on a document scanned by the scanner 61 indicates that a document is a first document of the next set, the document is transported into the gathering station 16 only up to a position in which a trailing end of the document is still in the nip between the most downstream supply rollers 29, 30, but has moved in transport direction far enough to have cleared the switch 81, so that the switch 81 is released and moves back to its rest portion. Then, the sense of rotation of the most downstream supply rollers 29, 30 is reversed and the divert switch 81 in the rest position urges the document into the divert station 80 in which the transport rollers 83 transport it until the document projects into the chute 85 and, if necessary until it projects outside the apparatus. Preferably, the diverted document is transported into the divert station only until the document has just cleared the supply track.

When transporting a document into the divert station 80, the conveyor belt 18 and the conveyor belt 17 may be driven so that their portions facing each other move in the direction of the divert station 80. The documents previously gathered between the conveyor belts 17, 18 are then also transported partially out of the gathering station, but are not transported into the divert station, because the trailing ends have cleared the nip between the most downstream supply rollers 29, 30 and are therefore moved in downstream direction passing underneath the most downstream supply rollers 29, 30. However, the previously gathered documents remain partially between the belts 17, 18 so that any inserts arriving via the supply track can be gathered with these documents in the gathering station 16. It is also possible to keep the belts 17, 18 stationary while a document is transported into the divert station 80 if it is ensured that the traction exerted by the most downstream supply rollers 29, exceeds the traction exerted on the diverted document between the belts 17, 18.

Next, the control system activates the feeding stations loaded with the inserts (enclosures) intended to be gathered with the current set for feeding the enclosures. These enclosures are transported along the supply track defined by conveyors 3, 4 towards the gathering station 16 and gathered at stop 26.

After a set of documents has been completed, the diverted document in the divert station 80 is transported to the gathering station 16 as the first document of the next set. In the present example, the switch 81 has a side facing the divert track, which face is formed to guide the leading end of the document moving out of the divert station 80 into the nip between the most downstream pair of rollers 29, 30 of the supply track. Then the feeding stations feed further documents until a next first sheet of a next set is identified, after which a processing cycle as described above is repeated.

By providing a sensor 63 in the supply track upstream of the gathering station 16 and downstream of the feeding stations 1, 2 and placing the divert station 80 downstream of the sensor 63, it is made possible to divert a document from the supply track to the divert station 80 in response to indicia scanned by the same scanner 63 that can also scan all other documents fed to the gathering station 16.

The apparatus according to the present example is also capable of handling manually fed sets of documents (in practice often referred to as "daily mail") constituting manually gathered sets of documents that are fed to the apparatus as a stacked set of documents (including inserts if any). When the apparatus is not in use for handling bulk mailing, such a manually gathered set of documents can be loaded into the divert station 80. In the example shown, the complete document set can be manually inserted into the chute 85 because the end of the chute 85 of the divert station 80, which faces away from the supply track, is directly open to the outside of the apparatus. In response to the sensor 64 detecting the presence of a document set, the system control activates the pair of transport rollers 83 and the set is transported along the divert guide 82 towards the gathering station 16. Once aligned, the set is transported to the discharge track 36 and the folding station 32 and processed in the same manner as a set of documents supplied from the feeding stations 1, 2.

That the divert station 80 has an end facing away from the supply track 3, 4, which is open to the outside of the apparatus, is not only advantageous for allowing "daily mail" to be fed to the divert station directly from outside the apparatus, but also for allowing diverted documents to be removed from the apparatus manually, for instance in the event of a jam, and for allowing diverted documents to project to the outside of the apparatus, which allows the apparatus to be of a relatively compact design.

After gathering a stack of documents in the gathering station, the stack is initially displaced counter to the direction of arrival at the gathering station and then to the folding station 32 by displacing the stop 26 and preferably also the belt 17. If a fold is to be made, the leading edge of the stack remote from the stop 26 and a contiguous portion of the stack are deflected along a pair of folding rollers 37, 38 or 39, 40 and are clamped against the proximal folding roller 37 or 39 of the respective pair of folding rollers 37, 38 or 39, 40. Next, the folding rollers are driven so that the deflected portion of the stack is bent further and is brought between the folding rollers, where a fold is made in the stack.

Thus, the position of each fold can advantageously be determined by means of the position of the edge of the stack on the side of the stop 26. By operating the pressing roller 431, depending on the position of the stop 26, the position of the folds can be determined easily and accurately.

Examples of a suitable folding station and a folding method are described in more detail in U.S. Pat. No. 5,090,671, to which reference is being made here for purposes of incorporation the teachings herein.

While the invention has been illustrated and described in detail in the drawing and foregoing description, such illustration and description are to be considered illustrative or exemplary and not restrictive; the invention is not limited to the disclosed embodiment. Instead of a divert switch that is moved passively by documents supplied along the supply track, the switch may also be actively movable between a position for guiding sheets along the supply track to the gathering station, from the gathering station to the divert station, from the divert station to the gathering station and/or from the gathering station to the folding station.

Instead of a pair of rollers, other means for displacing a document along the divert track may be provided, such as a conveyor belt. In another embodiment a document tray can be provided instead of a chute.

In yet another embodiment, wherein personalized documents are placed in predetermined feeding stations, the sensor can be placed downstream of only these feeding stations. Other feeding stations, containing enclosures, may then be positioned downstream of the sensor.

Other variations to the disclosed embodiments can be understood and effected by those skilled in the art in practicing the claimed invention, from a study of the drawings, the disclosure, and the appended claims.

What is claimed is:

1. An apparatus for gathering documents comprising:

a supply track;

at least two feeding stations arranged for feeding documents to the supply track;

at least one gathering station arranged for gathering documents arriving via the supply track into a stack;

a sensor along the supply track, positioned downstream of at least one of the feeding stations and positioned upstream of the at least one gathering station, for scanning markings from documents in the supply track and generating signals in accordance with the scanned markings;

a divert station arranged for diverting a document from the supply track downstream of the sensor and upstream of the at least one gathering station; and a drive structure arranged for driving displacement of documents from all the feeding stations along the supply track to the at least one gathering station, for driving displacement of documents from the supply track to the divert station, for driving displacement of documents stacked in the at least one gathering station, and for driving displacement of documents from the divert station along the supply track to the at least one gathering station; and a control system for controlling the drive structure;

wherein the control system is arranged for controlling the drive structure for:

driving, in response to a signal from the sensor representing a predetermined mark read from a document fed from one of the feeding stations, displacement of said document from the supply track into the divert station;

subsequently driving displacement of at least one document from another one of the feeding stations to the at least one gathering station;

subsequently driving displacement of the documents stacked in the at least one gathering station thereby clearing the at least one gathering station; and subsequently driving displacement of the document in the divert station to the at least one gathering station.

2. The apparatus according to claim 1, wherein the sensor and the divert station are positioned for scanning markings in a position downstream of all feeder stations.

3. The apparatus according to claim 1, wherein the divert station comprises:

transport members; and a divert track branching off from the supply track;

wherein the transport members are arranged for receiving a document from the supply track and for displacing the received document along the divert track.

4. The apparatus according to claim 1, wherein the divert station has an end facing away from the supply track, the end being open to an outside of the apparatus.

5. The apparatus according to claim 4, wherein the divert station further comprises a presence sensor for detecting a document present in the divert station and generating a signal if presence of a document is detected.

6. A method for gathering documents in apparatus comprising:

a supply track;

at least two feeding stations for feeding documents to the supply track;

at least one gathering station for gathering documents arriving via the supply track into a stack;

a sensor along the supply track downstream of at least one feeding station and upstream of the at least one gathering station, for scanning markings from documents in the supply track and generating signals in accordance with the scanned markings;

a divert station for diverting a document from the supply track downstream of the sensor and upstream of the at least one gathering station; and a drive structure for driving displacement of documents from all the feeding stations along the supply track to the at least one gathering station, for driving displacement of documents from the supply track to the divert station, for driving displacement of documents stacked in the at least one gathering station, and for driving displacement of documents from the divert station along the supply track to the at least one gathering station; and a control system for controlling the drive structure;

the method comprising:

driving, in response to a signal from the sensor representing a predetermined mark read from a document fed from one of the feeding stations, displacement of said document from the supply track into the divert station;

subsequently driving displacement of at least one document from another one of the feeding stations to the at least one gathering station;

subsequently driving displacement of the documents stacked in the at least one gathering station thereby clearing the at least one gathering station; and subsequently driving displacement of the document in the divert station to the at least one gathering station.

* * * * *